US006006791A

United States Patent [19]

Herrlein

[11] Patent Number: 6,006,791

[45] Date of Patent: Dec. 28, 1999

[54] LOOM WITH A DEVICE FOR DETECTING DEFICIENCIES IN A LENGTH OF FABRIC

[75] Inventor: Wilhelm Herrlein, Neuravensburg, Germany

[73] Assignee: Lindauer Dornier GmbH, Lindau, Germany

[21] Appl. No.: 09/042,561

[22] Filed: Mar. 17, 1998

[30] Foreign Application Priority Data

Mar. 27, 1997 [DE] Germany ..... 297 05 553 U

[51] Int. Cl.[6] ..... D03D 49/00; D03J 1/00

[52] U.S. Cl. ..... 139/1 B; 26/70; 250/559.01; D26/24

[58] Field of Search ..... 139/1 B; 26/70; 250/559.01; D26/24; 312/223.5

[56] References Cited

U.S. PATENT DOCUMENTS 3,502,115 3/1970 Barnett .
4,727,911 3/1988 Crawford et al. .
5,431,192 7/1995 Alexander, III .
5,433,253 7/1995 Toda et al. ..... 139/1 B
5,456,292 10/1995 Alexander, III .

FOREIGN PATENT DOCUMENTS 9078444A of 1997 Japan .

OTHER PUBLICATIONS

Search Report Jul. 1998 Germany.
Abstract, JP9078444A, 1997, Japan.

*Primary Examiner*—Andy Falik
*Attorney, Agent, or Firm*—Evenson McKeown Edwards & Lenahan, PLLC

[57] ABSTRACT

A loom has an illuminating unit for improving the detection of deficiencies in a length of fabric. The illuminating unit extends over the entire width of the loom and at least one illumination device. The illuminating unit is pivotably fastened between loom walls in the area of a free space defined by the fabric guidance rollers and the length of fabric itself. The illuminating unit illuminates the length of the fabric and is used as a safety cover over the roller gap between the rollers.

10 Claims, 2 Drawing Sheets

LOOM WITH A DEVICE FOR DETECTING DEFICIENCIES IN A LENGTH OF FABRIC

The invention relates to a loom with a device for improving the detection of deficiencies in a length of fabric, wherein the length of fabric is guided over several rollers, which are arranged axis-parallel, and is wound on a so-called fabric roller.

There are two fabric guidance rollers, for example, over which the length of fabric is conducted in a stretched manner.

In the course of the draw-off process of the length of fabric, the weaver makes spot checks of the quality of the goods in order to detect deficiencies in the fabric in a timely manner. To this end the fabric, which is guided stretched over a first roller and a second roller, offers the chance of a visual inspection in regard to deficiencies.

Not every deficiency in a fabric can be detected without additional lighting. This is particularly true if there is insufficient light provided in the mill. It is difficult for the weaver to visually detect faults in the length of fabric, even in incident light.

It is an object of the invention to produce a loom with a device for the improved detection of deficiencies in the length of fabric produced.

This object is attained according to preferred embodiments of the invention by providing a loom with a device for improving the detection of deficiencies in a length of fabric, which is conducted stretched between at least one first and one second roller of a roller arrangement, wherein the loom has a left exterior and a right exterior loom wall, wherein the rollers are seated with their ends and axis-parallel in the loom walls and are arranged spaced apart from each other in such a way that a defined free space is formed between the rollers, wherein an illuminating unit with at least one illuminating device is arranged within the free space in such a way that the illuminating unit directedly illuminates the length of fabric conducted over the rollers.

An important characteristic of the invention is the integration of an illuminating unit in a loom, namely in a free space defined by a plurality of fabric guidance rollers, which is covered by the maximally producible width of a length of fabric. The illuminating unit is arranged in such a way that deficiencies present in the length of fabric can be well detected by means of the method of examination against the light.

By means of a device arranged in accordance with the invention, the weaver therefore can readily visually inspect the fabric and detect weaving errors better than before.

The illuminating unit itself comprises an elongated reflector of an approximate U-shape, in which suitable illuminating devices are received. In especially preferred embodiments, one or several fluorescent tubes are provided as the illuminating devices. Preferably the illuminating devices extend over the entire weaving width of the loom.

The illuminating unit is connected with support arms, which are respectively pivotably attached to the first and second loom walls. These support arms facilitate pivoting of the illuminating unit within the defined free space around center axes of respective bolts retaining the respective support arm at the inner loom wall. The pivoting of the illuminating unit is useful for performing maintenance work on the unit and for adapting the positioning of the illumination to the requirements of the weaver.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
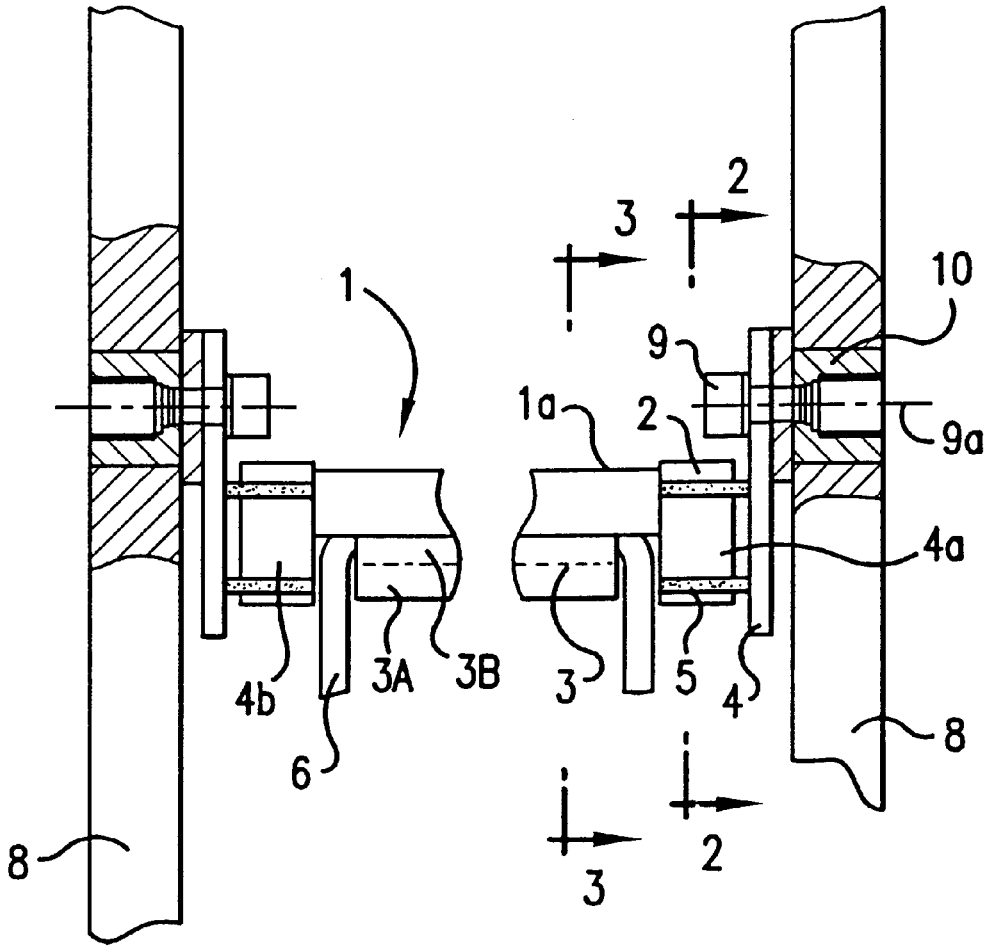
FIG. 1 is a schematic part sectional front view of an illuminating unit for a loom, constructed in accordance with a preferred embodiment of the invention.

FIG. 1 shows the arrangement of an illuminating unit 1 disposed on a loom. The unit 1 includes an elongated reflector 1*a* of an approximate U-shape and a receptacle 2 at respective ends which extend around the reflector 1*a*. Plug-in sockets 5 have been plugged into the receptacles 2 for fastening the reflector 1*a*. Each plug-in socket 5 is supported by a pin 4*a* provided on the support arm 4. The support arms 4 are fastened on the respective loom wall 8. Recesses, for example through-bores, are provided on the loom walls 8, into each of which an insert 10 has been respectively inserted. The support arms 4, which support the device 1, are fastened in these inserts 10 with the aid of fastening bolts 9.

An elongated illuminating device 3, preferably a cold light fluorescent tube, is located in the unit 1 itself. A plurality of light tubes 3A, 3B could also be used as schematically depicted in FIG. 1. The current supply of the illuminating device 3 is provided by means of supply cables 6.

Figure 2:
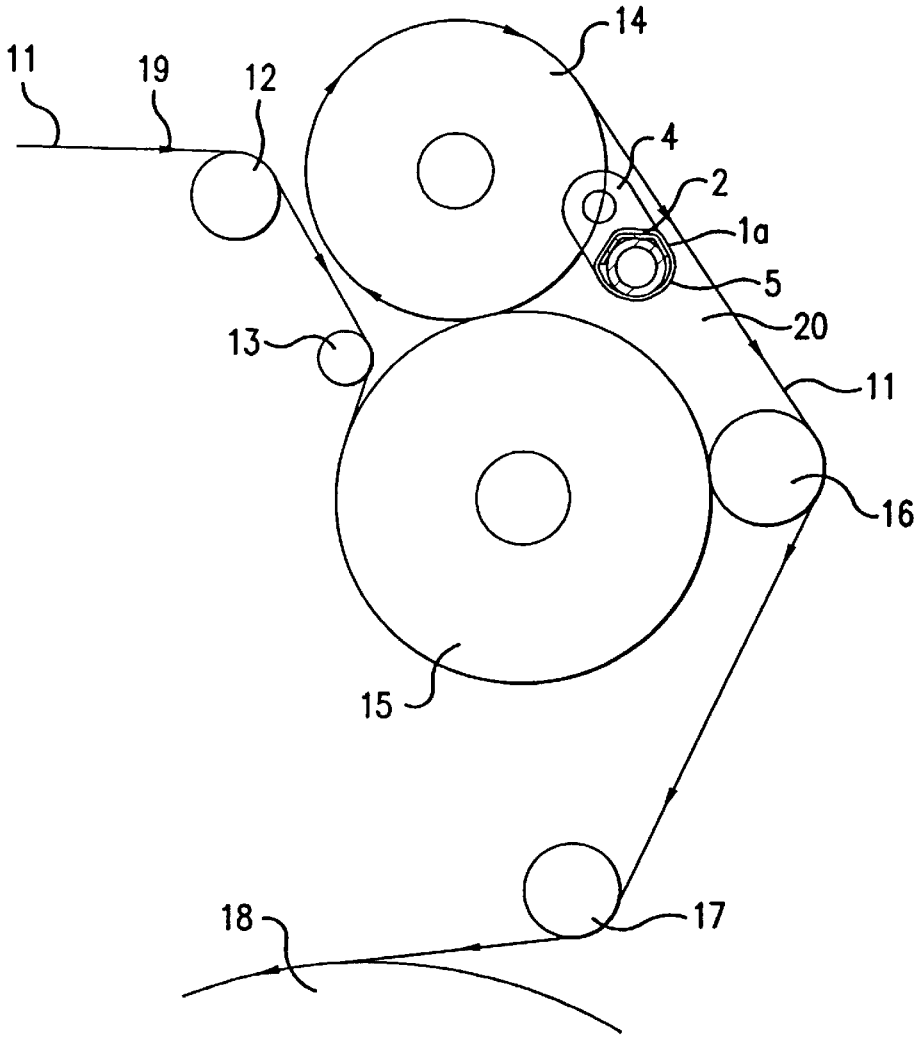
FIG. 2 is a sectional view along the line A—A in FIG. 1, enlarged in respect to FIG. 1, with the schematic representation of several fabric guidance rollers of the loom.

FIG. 2 schematically represents the arrangement of the illuminating unit 1 within a free space 20 defined between the fabric 11 and the fabric guide rollers. The length of fabric 11 is drawn off in the direction of the arrow 19 over deflection rollers 12, 13 and reaches the lower roller 15. In the example shown, the length of fabric 11 is guided counterclockwise on the circumference of the lower roller 15 and thereafter is conducted to an upper roller 14 arranged above the lower roller 15. The length of fabric runs over the circumference of the upper roller 14 and over further rollers 16, 17, which conduct the length of fabric 11 to a fabric roller 18, on which the length of fabric is wound.

The illuminating unit 1 is pivotably arranged between the loom walls 8 in the area of the free space 20 defined by the rollers 14, 15, 16 and the length of fabric 11 itself.

Since the length of fabric 11 is stretched flat above this free space, a good visual examination of the length of fabric in regard to deficiencies is possible by the light of the unit 1. Simultaneously the gap existing between the rollers 14, 15 for leading the length of fabric 11 through is covered over its entire length in an advantageous manner, with the illuminating unit 1 also serving as a safety cover for said gap.

Figure 3:
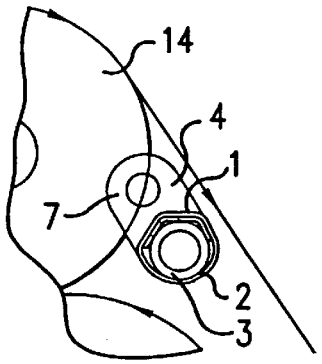
FIG. 3 is a sectional view along the line B—B in FIG. 1.

FIG. 3 represents a sectional view of how the illuminating devices 3 are arranged in the illuminating unit 1. As can be seen, the support arm 4 together with the device 1 can be pivoted in the direction of the two-headed arrow 7. This is useful for performing maintenance work on the loom or on the unit 1 easier and for adapting the position of the unit 1 (its angle of illumination, etc.) to the requirements of the weaver.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A loom with an illuminating unit for improving detection of deficiencies in a length of fabric which is stretched between at least one first and one second roller of a roller arrangement, wherein the loom has a left exterior and a right exterior loom wall, wherein the rollers are axis-parallel with their ends seated in the loom walls, said rollers being arranged spaced apart from each other in such a way that a defined free space is formed between the rollers and the fabric, wherein the illuminating unit with at least one illuminating device is arranged within the free space in such a way that the at least one illuminating device directedly illuminates the length of fabric conducted over the rollers, wherein the illuminating unit includes a reflector with an approximately U-shaped cross section, whose free ends are each enclosed in respectively one receptacle, and wherein the receptacles are connected with a support arm which is pivotably fastened on the loom wall.

2. The loom in accordance with claim 1, wherein the receptacles are each connected with a plug-in socket respectively provided at receptive free ends of the support arm.

3. The loom in accordance with claim 1, wherein the at least one illuminating device is a fluorescent tube.

4. The loom in accordance with claim 3, wherein several fluorescent tubes are employed as illuminating devices.

5. A loom according to claim 1, wherein said roller arrangement includes a third roller which forms a gap together with one of said first and second rollers, said gap facing the free space, and wherein the illuminating unit is configured and disposed in an in-use position so as to serve as a safety cover with respect to said gap.

6. A loom assembly including an illuminating unit for improving detection of deficiencies in a length of fabric which is stretched between at least one first and one second roller of a roller arrangement on said loom assembly, said loom assembly having a left exterior and a right exterior loom wall which face one another, the rollers being axis-parallel with their ends supported at the loom walls and being arranged spaced apart from each other in such a way that a defined free space, is defined by the rollers and the fabric during operation of the loom assembly, said illuminating unit comprising:

at least one illuminating device adapted to be arranged within the free space in such a way that the at least one illuminating device directly illuminates the length of fabric conducted over the rollers, wherein the illuminating unit includes a reflector with an approximately U-shaped cross section, whose free ends are each enclosed in respectively one receptacle, and wherein the receptacles are connected with a support arm pivotably fastened on the loom walls.

7. The loom assembly in accordance with claim 6, wherein the receptacles are each connected with a plug-in socket respectively provided at respective free ends of the support arms.

8. The loom assembly in accordance with claim 6, wherein the at least one illuminating device is a fluorescent tube.

9. The loom assembly in accordance with claim 8, wherein several fluorescent tubes are employed as illuminating devices.

10. The loom assembly according to claim 6, wherein said roller arrangement includes a third roller which in use forms a gap together with one of said first and second rollers, said gap facing the free space, and wherein the illuminating unit is configured and adapted to be disposed in an in-use position so as to serve as a safety cover with respect to said gap.

* * * * *